US005948366A

United States Patent [19]

Rüther

[11] Patent Number: 5,948,366

[45] Date of Patent: Sep. 7, 1999

[54] GLASS AMPOULE FOR HOLDING A DRUG A CALIBRATION LIQUID OR A QUALITY CONTROL LIQUID

[75] Inventor: Horst Rüther, Hart/Graz, Austria

[73] Assignee: AVL Medical INstruments AG, Schaffhausen, Switzerland

[21] Appl. No.: 09/000,948

[22] Filed: Dec. 30, 1997

[30] Foreign Application Priority Data

Nov. 24, 1997 [EP] European Pat. Off. ..... 978902231

[51] Int. Cl.[6] ..... B01L 3/00

[52] U.S. Cl. ..... 422/102; 422/99; 436/8

[58] Field of Search ..... 422/99, 102; 435/287.6, 435/288.1; 436/8

[56] References Cited

U.S. PATENT DOCUMENTS

| | | | |
|---|---|---|---|
| 1,951,743 | 3/1934 | Thomae | 604/200 |
| 3,535,070 | 10/1970 | Francel et al. | 215/49 |
| 3,749,271 | 7/1973 | Ellis, Jr. et al. | 215/47 |
| 3,892,237 | 7/1975 | Steiner | 604/200 |
| 4,096,683 | 6/1978 | McMickle, Jr. | 53/244 |
| 4,266,681 | 5/1981 | Fredericks | 215/47 |
| 4,604,965 | 8/1986 | Dehais | 118/219 |
| 4,793,538 | 12/1988 | Blomberg | 225/93 |
| 5,179,024 | 1/1993 | Dahms | 436/42 |
| 5,221,311 | 6/1993 | Rising et al. | 65/102 |
| 5,628,353 | 5/1997 | Ruther | 141/330 |

FOREIGN PATENT DOCUMENTS

| | | |
|---|---|---|
| 0694498 | 1/1996 | European Pat. Off. . |
| 721646 | 12/1931 | France . |
| 1241230 | 8/1960 | France . |
| 3130202 | 5/1982 | Germany . |
| 287394 | 4/1953 | Switzerland . |
| 607138 | 4/1978 | U.S.S.R. . |
| 1531 | 12/1915 | United Kingdom . |
| 198993 | 8/1924 | United Kingdom . |

*Primary Examiner*—Maureen M. Wallenhorst
*Attorney, Agent, or Firm*—Watson Cole Grindle Watson, P.L.L.C.

[57] ABSTRACT

In a glass ampoule for holding a drug, a calibration liquid or a quality control liquid, whose bottom is flat or recessed towards the interior of the ampoule, the bottom area is shaped and/or coated such that a predefined breaking site is provided, which can be mechanically destroyed with little use of force.

20 Claims, 2 Drawing Sheets

GLASS AMPOULE FOR HOLDING A DRUG A CALIBRATION LIQUID OR A QUALITY CONTROL LIQUID

BACKGROUND OF THE INVENTION

This invention relates to a glass ampoule for holding a liquid, for example, a drug, or a liquid for calibration or quality control, with an essentially flat bottom or with a bottom area that is recessed towards the interior of the ampoule.

Such ampoules are widely used, above all in medical laboratories, doctors' practices and hospitals, and are usually broken open by hand before use.

In many applications, in particular in the instance of calibration and/or quality control of laboratory equipment, the manipulations involved in handling liquids from such glass vials are far from convenient.

DESCRIPTION OF THE PRIOR ART

A device for automatic withdrawal of a liquid from a sealed glass ampoule is disclosed in EP 0 694 498 B1, where the glass ampoule is held in a rack in upright position, its bottom facing upwards. The bottom of the glass ampoule is mechanically destroyed by a single-lumen cannula with a rigid wall, which is also used for withdrawing the liquid from a splinterfree zone of the ampoule.

Problems may arise in this context, especially if parts of the wall are destroyed along with the bottom part of the ampoule, or if relatively large forces must be applied to insert the withdrawing element through the ampoule bottom. A satisfactory solution of these problems is not always possible, even if the ampoule bottom has a conical depression in its center, as described in FR 721 646 A.

SUMMARY OF THE INVENTION

It is an object of this invention to further develop known kinds of glass ampoules for holding liquids in such a manner as to ensure that the ampoule can be opened easily through the bottom area by means of automatically operated withdrawing elements.

This object is achieved in the invention by shaping and/or coating the bottom area such that a defined breaking site is provided, which can be mechanically destroyed with little use of force.

It will be a special advantage to provide the bottom area with an asymmetrical, conical depression. Such asymmetrical, conical depressions may be produced during the manufacturing process, for example, by blowing, where parts of the ampoule bottom are blown into the ampoule interior in reproducible shape and depth. Recesses of approximately half the ampoule diameter have proved of advantage in this context. To reinforce the recessed area, it may be cooled down locally during blowing, and the optimum depth of the depression may be automatically monitored by optical means. Due to the reduced rigidity of the bottom area, which is caused by the asymmetric shape of the depression, a cannula for withdrawing the liquid content may be inserted into the glass ampoule with comparatively little effort, and the formation of splinters will be restricted essentially to the asymmetrically shaped area.

The physical effort involved in destroying the ampoule bottom is further diminished by providing that the recessed area of the bottom have a reduced wall thickness compared to that of the ampoule, i.e., reduced by preferably 30 to 60 percent. In the instance of an asymmetrical depression, the areas of the recess which are pierced by the withdrawing element, may be thinnest. In this way the impact angle of the withdrawing element is improved and the forces transmitted to the rim of the ampoule are diminished.

To reduce the local surface tension of the bottom area a coating may be provided which is made of a material that will give rise to tensional forces between the coated bottom area and the coating itself. This coating, which may consist of ceramic material, for example, could be limited to a single spot in the center of the recessed area or to the impact point of a withdrawing element.

In the invention similar effects may be obtained by providing the bottom area with an essentially cylindrical depression with a flat or slightly curved bottom.

The invention would also permit the use of glass ampoules with an essentially flat bottom, whose central area, preferably, is provided with a ceramic coating for local reduction of the surface tension, a further option being that the bottom of the glass ampoule, and in particular its center area, should have a wall thickness smaller than that of the glass ampoule, i.e., preferably reduced by 30 to 60 percent.

BRIEF DESCRIPTION OF THE DRAWINGS

The invention will be further described now with reference to the accompanying drawings, in which.

DESCRIPTION OF PREFERRED EMBODIMENTS

Figure 1A:
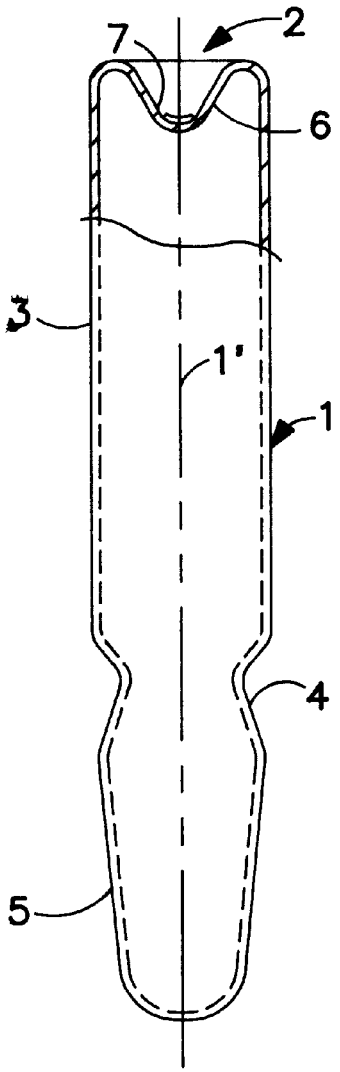
FIG. 1*a* is a view of an ampoule of the invention in a partial axial section.

The glass ampoule 1 for holding a liquid as shown in FIG. 1*a* has a bottom area 2 which is recessed towards the ampoule interior. The cylindrical wall area 3 of the ampoule 1 is followed by a neck area 4, which in turn ends in a tip 5. The areas 3 and 4 essentially may assume any desired shape, provided that the ampoule can be inserted into a device for automatic withdrawal of the ampoule liquid, as is described in EP 0 694 498 B1, for instance.

Figure 1B:
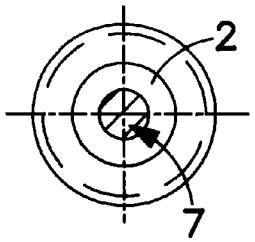
FIG. 1*b* is a view from above of the bottom area of the ampoule as shown in FIG. 1*a*, and FIG. 2*a* to 4*a*, and 2*b* to 4*b* show variants of the ampoule described by the invention.

The bottom area 2 of the ampoule as shown in FIG. 1*a* has a conical depression 6 which is provided with a spot of ceramic coating 7 in the center of the recessed area 2 (see also FIG. 1*b*).

Figure 2A:
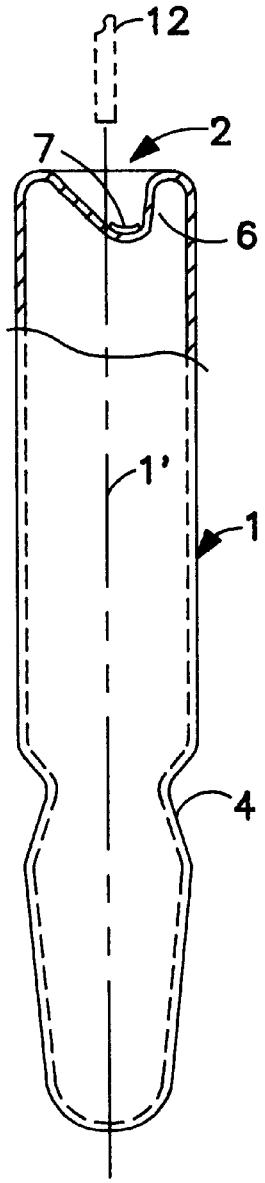
Figure 2B:
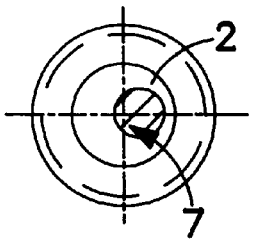

The variant shown in FIGS. 2*a* and 2*b* is characterized by an asymmetrical, conical depression 6' of reduced wall thickness, such that a withdrawing element 12 centered on the ampoule axis 1' will meet with diminished mechanical resistance when breaking open the ampoule bottom. As is seen in FIG. 2*b*, the ceramic coating 7 again is asymmetrical, i.e., placed at the lowest point of the conical depression 6'.

Figure 3A:
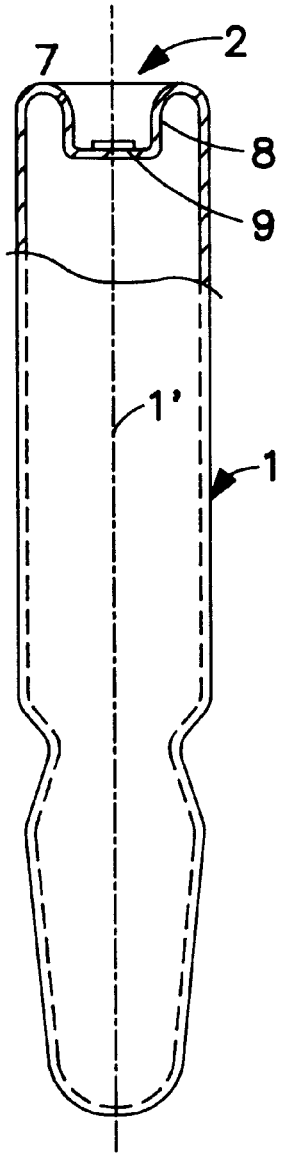
Figure 3B:
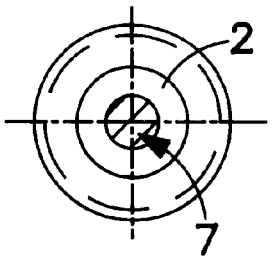

In the variant of FIGS. 3*a* and 3*b* the bottom area 2 of the ampoule 1 exhibits an essentially cylindrical depression 8 with a flat or slightly curved bottom 9. The wall thickness of the recessed bottom area 2 may be reduced compared to the wall thickness of the glass ampoule 1, either over its entirety or in a center area only.

Figure 4A:
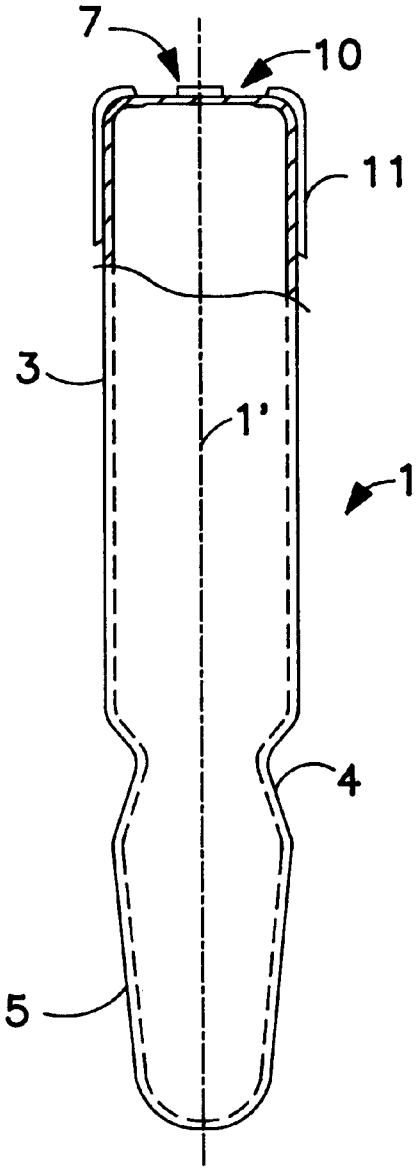
Figure 4B:
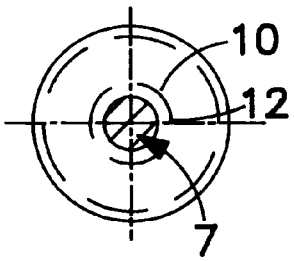

FIGS. 4*a* and 4*b* present a variant of a glass ampoule 1 which is characterized by an essentially flat bottom 10, that has a reduced wall thickness (30–60%), either over its entirety or in its center area, in order to facilitate penetration of the withdrawing element. Such bottoms may be fusionwelded onto the body of the ampoule, for instance. The center area may again be coated with a ceramic coating 7 in the shape of a ceramic spot.

Another possible variant would be that the bottom area or bottom 10 of the glass ampoule 1 be provided with a slight cut, preferably a circular cut 12.

Furthermore, in all variants an elastomer coating 11 may be provided as indicated in FIG. 4*a*, which is applied on a cylindrical wall area 3 adjacent to the bottom 10 (bottom area 2) of the glass ampoule 1. This elastomer coating serves to retain any glass splinters in the lower area of the ampoule body.

I claim:

1. A glass ampoule for holding a drug, a calibration liquid, or a quality control liquid, comprising a cylindrical wall adjacent to a recessed or an essentially flat bottom, wherein a center of said bottom is provided with a coating made of a material which causes tensional forces between said coated bottom and said coating.

2. A glass ampoule as claimed in claim 1, wherein said coating material is ceramics.

3. A glass ampoule as claimed in claim 1, wherein the center of said bottom of said glass ampoule has a 30 to 60 percent reduced wall thickness compared to the wall thickness of said cylindrical wall.

4. A glass ampoule as claimed in claim 1, wherein said bottom of said glass ampoule is provided with a slight cut.

5. A glass ampoule as claimed in claim 4, wherein said cut is circular.

6. A glass ampoule as claimed in claim 1, wherein said cylindrical wall adjacent to said bottom of said glass ampoule is provided with an elastomer coating.

7. A glass ampoule for holding a drug, a calibration liquid or a quality control liquid, comprising a cylindrical wall adjacent to a mechanically destroyable recessed bottom area being provided with a shape defining a breaking site, wherein said bottom area is provided with an asymmetrical, conical depression.

8. A glass ampoule as claimed in claim 7, wherein said recessed bottom area has a 30 to 60 percent reduced wall thickness compared to the wall thickness of said cylindrical wall.

9. A glass ampoule as claimed in claim 7, wherein the center of said recessed bottom area, is provided with a coating made of a material which causes tensional forces between said coated bottom area and said coating.

10. A glass ampoule as claimed in claim 9, wherein said coating material is ceramics.

11. A glass ampoule as claimed in claim 7, wherein the recessed bottom area is provided with a slight cut.

12. A glass ampoule as claimed in claim 7, wherein said cut is circular.

13. A glass ampoule as claimed in claim 7, wherein said cylindrical wall adjacent to said recessed bottom area is provided with an elastomer coating.

14. A glass ampoule for holding a drug, a calibration liquid or a quality control liquid, comprising a cylindrical wall adjacent to a mechanically destroyable recessed bottom area provided with a shape defining a breaking site, wherein said bottom area is provided with an essentially cylindrical depression with a flat or slightly curved bottom.

15. A glass ampoule as claimed in claim 4, wherein said recessed bottom area has a 30 to 60 percent reduced wall thickness compared to the wall thickness of said cylindrical wall.

16. A glass ampoule as claimed in claim 4, wherein the center of said recessed bottom area is provided with a coating made of a material which causes tensional forces between said coated bottom area and said coating.

17. A glass ampoule as claimed in claim 16, wherein said coating material is ceramics.

18. A glass ampoule as claimed in claim 4, wherein the recessed bottom area is provided with a slight cut.

19. A glass ampoule as claimed in claim 18, wherein said cut is circular.

20. A glass ampoule as claimed in claim 14, wherein said cylindrical wall adjacent to said recessed bottom area is provided with an elastomer coating.

* * * * *

UNITED STATES PATENT AND TRADEMARK OFFICE

CERTIFICATE OF CORRECTION

PATENT NO. : 5,948,366

DATED : September 7, 1999

INVENTOR(S) : Horst RUTHER

It is certified that error appears in the above-identified patent and that said Letters Patent are hereby corrected as shown below:

In the heading,

[73] Assignee: AVL Medical Instruments AG, Schaffhausen, Switzerland

[30] Foreign Application Priority Data

Nov. 24, 1997 [EP] European Pat. Off. .....97890231

Signed and Sealed this

Tenth Day of April, 2001

*Attest:*

Nicholas P. Godici

NICHOLAS P. GODICI

*Attesting Officer*

*Acting Director of the United States Patent and Trademark Office*